United States Patent [19]

Berg

[11] Patent Number: 4,804,219

[45] Date of Patent: Feb. 14, 1989

[54] SNOW SHOVEL

[76] Inventor: Clara Berg, 4940 N. Wildwood Ave., Whitefish Bay, Wis. 53217

[21] Appl. No.: 162,182

[22] Filed: Feb. 29, 1988

[51] Int. Cl.[4] ..... E01H 5/02

[52] U.S. Cl. ..... 294/54.5; 37/130; 37/283; 37/284; 294/59

[58] Field of Search ..... 294/49, 51, 53.5, 54.5, 294/55, 59; 15/246, 257.1, 257.8; 37/130, 131, 137, 265, 271, 278, 283–285; 254/131.5

[56] References Cited

U.S. PATENT DOCUMENTS

| | | | |
|---|---|---|---|
| 567,391 | 9/1896 | Hopper | 254/131.5 |
| 1,232,361 | 7/1917 | Mills | 294/59 |
| 1,683,732 | 9/1928 | Selin | 37/130 |
| 2,520,606 | 8/1950 | McLoughlin | 294/54.5 X |
| 2,715,786 | 8/1955 | Dorko | 37/283 |
| 2,772,490 | 12/1956 | Hnastchenko | 37/284 |
| 2,846,785 | 8/1958 | Underwood | 294/54.5 X |
| 2,930,152 | 3/1960 | Pipkin | 294/54.5 X |
| 3,748,761 | 7/1973 | Chetwynde | 294/54.5 X |
| 4,214,385 | 7/1980 | Baranowski et al. | 37/130 |

FOREIGN PATENT DOCUMENTS

| | | | |
|---|---|---|---|
| 1132574 | 7/1962 | Fed. Rep. of Germany | 37/283 |
| 1219507 | 6/1966 | Fed. Rep. of Germany | 37/284 |
| 3503328 | 8/1986 | Fed. Rep. of Germany | 37/265 |
| 559313 | 9/1923 | France | 254/131.5 |
| 742278 | 12/1955 | United Kingdom | 294/59 |

*Primary Examiner*—Johnny D. Cherry
*Attorney, Agent, or Firm*—Fred Wiviott

[57] ABSTRACT

A snow shovel has a blade and a handle extending therefrom. A pair of rollers are mounted behind the lower edge of the blade by an upwardly extending support arm which is mounted on the handle for longitudinal and rotational adjustment.

3 Claims, 1 Drawing Sheet

SNOW SHOVEL

SUMMARY OF THE INVENTION

This invention relates to snow shovels and more particularly to snow shovels having rollers mounted thereon.

In general terms, the invention comprises a snow shovel having rollers mounted behind the blade and adjacent its lower edge. According to the preferred embodiment of the invention, the rollers are mounted at the lower end of a support art which is releasably mounted to the handle for longitudinal and rotational adjustment relative thereto.

Figure 2:
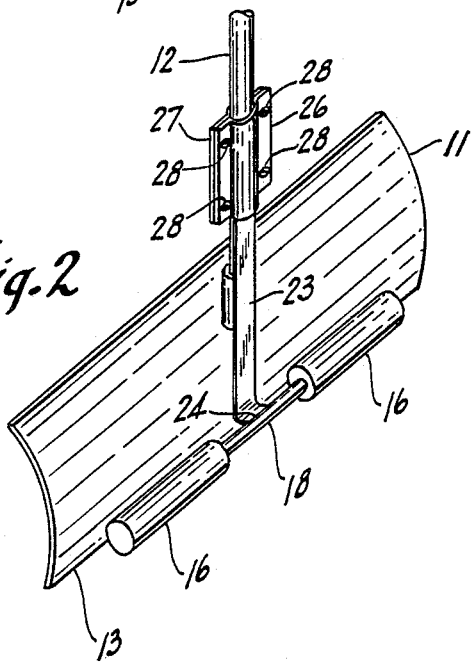
FIG. 2 is a perspective view of the preferred embodiment of the invention.
Figure 4:
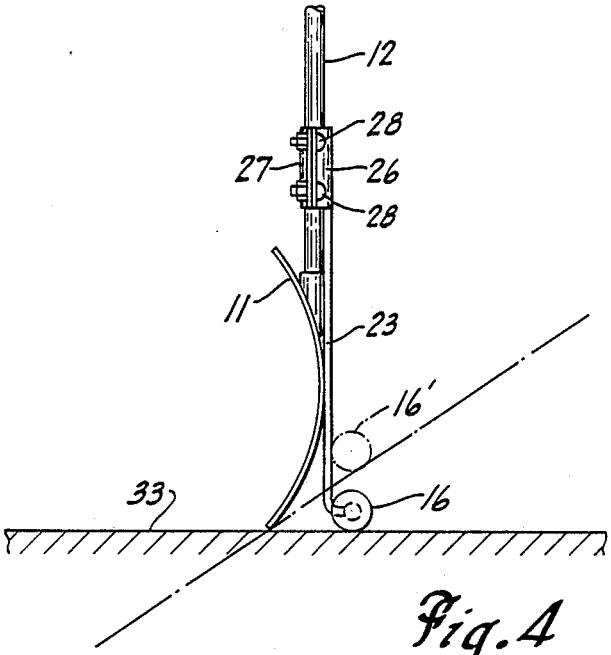
Figure 5:
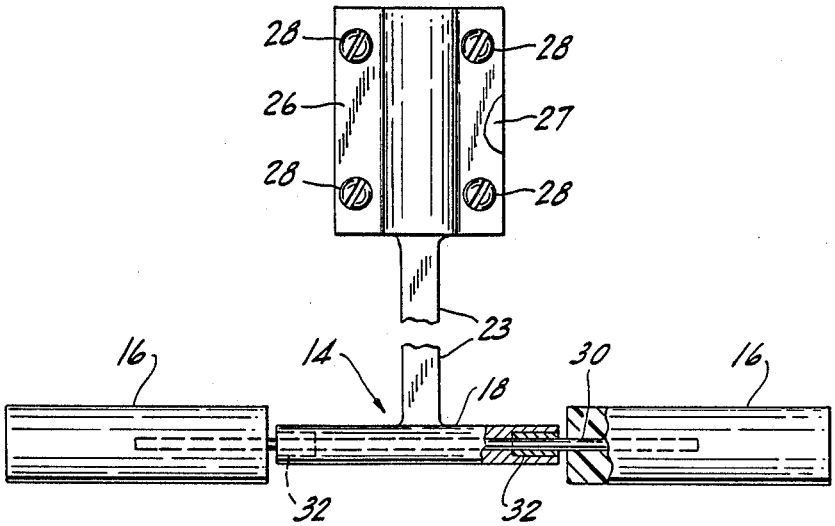

FIG..3 is a perspective view showing one manner of adjustability of the shovel according to the invention;

FIG. 4 is a side elevational view showing another manner of adjustability of the shovel according to the preferred embodiment of the invention; and FIG. 5 shows the roller assembly of the shovel of FIG. 2 in greater detail.

DETAILED DESCRIPTION OF THE PREFERRED EMBODIMENTS

Figure 1:
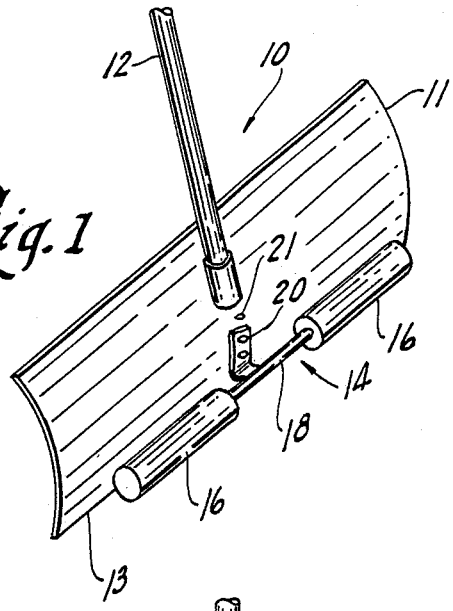
FIG. 1 is a perspective view of one embodiment of the invention.

FIG. 1 shows a snow shovel 10 having a conventional blade 11 and a handle 12 suitably coupled to the upper rear portion of the blade 11. Wihle the blade 11 may have any conventional configuration, in the illustrated embodiments, it is accurate in vertical section and has a lower edge 13 in contact with the surface being cleaned.

A roller assembly 14 is mounted on the rear surface of the blade 11 and adjacent its lower edge 13. The roller assembly 14 includes a pair of elongate rollers 16 mounted for rotation co-axially in a tubular carrier 18. A bracket 20 extends integrally from the carrier 18 and may be secured to the blade 11 in any suitable manner, such as by bolts 21 which extend through a line of vertially oriented holes formed in blade 11. Preferably, there are extra holes in balde 11 so that the position of roller assembly 14 can be adjusted relative to the lower edge 13 of blade 11. While elongate rollers 16 are shown, those skilled in the art will appreciate that narrower wheels may also be used but that the longer rollers provide greater stability.

Figure 3:
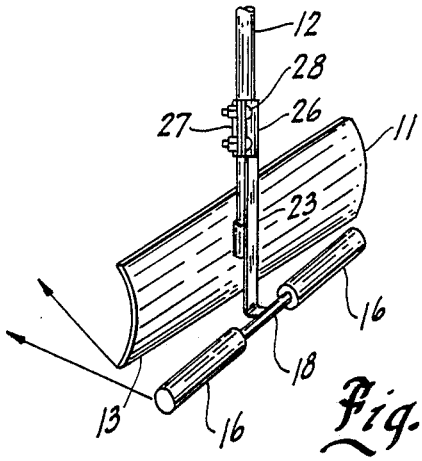

In the preferred embodiment of the invention shown in FIGS. 2–4, the carrier 18 is shown to be mounted at the lower end of a support arm 23. In particular, arm 23 may be formed of an elongate bar of a suitable metallic material. A rearward bend 24 extends from the lower end of arm 23 and is integrally formed with the carrier 18. At the upper end of arm 23 an integral arcuate clamp jaw 26 is formed for engaging one side of the handle 12. A mating clamp jaw 27 engages the opposite side of the handle 12 and the two are joined by means of bolts 28. It will be appreciated that when the bolts 28 are tightened, the jaws 26 and 27 clamp tightly to the opposite sides of the handle 12 so that the arm 23 and the roller assembly 14 are fixed in position relative to the blade 11. By loosening the bolts 28, the arm 23 can be moved in a direction parallel to or rotated around the axis of the handle 12. Longitudinal adjustment of the arm 23 along the handle 12, as shown in FIG. 4, changes the angle of the blade 11 relative to the surface being cleaned. Rotational adjustment of the arm 23 about the handle 12 changes the angle of the blade relative to the direction of forward travel as shown in FIG. 3.

The roller assembly 14 is shown in FIG. 5 to include a shaft 30 upon which the rollers 16 are fixedly mounted. Shaft 30 extends through carrier 18 and is rotationally supported in bearings 32 mounted at the opposite ends of carrier 18.

The rollers 16 greatly reduced frictional drag of the shovel blade 11 as it moves over the surface being cleaned. I addition, by changing the relative angles of the blade with respect to the surface 32, various plowing affects can be achieved. The use of a roller assembly according to the invention could also be applied to other cleaning instruments such as brooms and mops.

While only a few embodiments of the invention have been illustrated and described, it is not intended to be limited thereby but only by the scope of the appended claims.

I claim:

1. A snow shovel having an elongate handle and a blade mounted at one end of the handle and having a lower edge, a roller assembly mounted on the handle behind the blade and adjacent its lower edge, mounting means for releasably securing the roller assembly to the handle, said mounting means including a member for supporting the roller assembly and an adjustable clamp engagable with the handle for securing said member to said handle and for steplessly adjustably positioning the roller assembly in fixed longitudinal and rotational positions relative to the lower edge of the blade so that the roller assembly may be steplessly adjusted longitudinally and rotationally relative to the handle whereby different fixed vertical and rotational angles of the blade may be achieved relative to the surface being cleaned when the roller assembly and the lower edge of the blade are in engagement with said surface.

2. The shovel set forth in claim 1 wherein said roller assembly includes a pair of elongate rollers and said member comprises a carrier mounted on said clamp, said rollers being rotationally mounted on said carrier and extending on opposite sides of the handle and along the lower edge of the blade.

3. The shovel set forth in claim 2 wherein said member comprises an elongate arm, said carrier being mounted at one end of said arm and said clamp being mounted at the other end of said arm for releasably engaging said handle.

* * * * *